US010934602B2

(12) United States Patent
Gaganov et al.

(10) Patent No.: US 10,934,602 B2
(45) **Date of Patent: *Mar. 2, 2021**

(54) HIGH-STRENGTH FLAT STEEL PRODUCT

(71) Applicants: ThyssenKrupp Steel Europe AG, Duisburg (DE); ThyssenKrupp AG, Essen (DE)

(72) Inventors: Alexander Gaganov, Mülheim an der Ruhr (DE); Wolfgang Gervers, Duisburg (DE); Andreas Kern, Ratingen (DE); Gabriel Kolek, Witten (DE); Elena Schaffnit, Düsseldorf (DE); Hans-Joachim Tschersich, Dorsten (DE)

(73) Assignees: THYSSENKRUPP STEEL EUROPE AG, Duisburg (DE); THYSSENKRUPP AG, Essen (DE)

( * ) Notice: Subject to any disclaimer, the term of this patent is extended or adjusted under 35 U.S.C. 154(b) by 82 days.

This patent is subject to a terminal disclaimer.

(21) Appl. No.: 16/294,468

(22) Filed: Mar. 6, 2019

(65) Prior Publication Data

US 2019/0203318 A1 Jul. 4, 2019

Related U.S. Application Data

(63) Continuation of application No. 15/127,529, filed as application No. PCT/EP2015/055685 on Mar. 18, 2015, now Pat. No. 10,280,477.

(30) Foreign Application Priority Data

Mar. 25, 2014 (EP) ..... 14161606

(51) Int. Cl.

| | |
|---|---|
| ***C21D 9/52*** | (2006.01) |
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/00*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |
| ***C22C 38/60*** | (2006.01) |

(52) U.S. Cl.

CPC ..... *C21D 9/52* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C22C 38/60* (2013.01); *C21D 2211/002* (2013.01)

(58) Field of Classification Search

CPC ..... C21D 9/52; C21D 8/0226; C21D 38/001; C21D 38/02; C21D 38/04; C21D 38/06; C21D 38/12; C21D 38/14; C21D 38/32; C21D 2211/002

See application file for complete search history.

(56) References Cited

U.S. PATENT DOCUMENTS

| | | | | |
|---|---|---|---|---|
| 6,364,968 | B1 | 4/2002 | Yasuhara et al. | |
| 8,038,809 | B2 * | 10/2011 | Satou | C22C 38/50 148/320 |
| 10,280,477 | B2 * | 5/2019 | Gaganov | C21D 9/52 |
| 2011/0232807 | A1 | 9/2011 | Yoshinaga et al. | |
| 2013/0167985 | A1 | 7/2013 | Saito et al. | |

FOREIGN PATENT DOCUMENTS

| | | | |
|---|---|---|---|
| CN | 103526111 | A | 1/2014 |
| EP | 2130938 | A1 | 12/2009 |
| EP | 2436797 | A1 | 4/2012 |
| JP | 07316736 | A | 12/1995 |

OTHER PUBLICATIONS

Zhongdeng, Zhuanye et al., "Rolling Technology", edited by Qu Ke, Anshan Iron and Steel School ISBN 7-5024-0835-5, 1991. pp. 408-413.

* cited by examiner

*Primary Examiner* — C Melissa Koslow
(74) *Attorney, Agent, or Firm* — The Webb Law Firm

(57) ABSTRACT

A hot rolled flat steel product including (in % by weight) of C: 0.05-0.08%, Si: 0.015-0.500%, Mn: 1.60-2.00%, P: up to 0.025%, S: up to 0.010%, Al: 0.020-0.050%, N: up to 0.006%, Cr: up to 0.40%, Nb: 0.060-0.070%, B: 0.0005-0.0025%, Ti: 0.090-0.130%, unavoidable impurities including up to 0.12% Cu, up to 0.100% Ni, up to 0.010% V, up to 0.004% Mo, and up to 0.004% Sb, and the remainder being iron. The hot rolled flat steel product has a yield strength of 700-850 MPa, a fracture elongation of at least 12%, and a microstructure of at least 70% by volume bainitic microstructure.

12 Claims, No Drawings

HIGH-STRENGTH FLAT STEEL PRODUCT

CROSS REFERENCE TO RELATED APPLICATIONS

This application is a continuation of U.S. application Ser. No. 15/127,529 filed on Sep. 20, 2016, now U.S. Pat. No. 10,280,477, which is the United States national phase of International Application No. PCT/EP2015/055685, filed Mar. 18, 2015, which claims priority to European Patent Application No. 14 161 606.0 filed Mar. 25, 2014, the disclosure of each of which is hereby incorporated by reference in its entirety.

FIELD

The present disclosure relates to methods of producing flat steel products that have a high yield strength and a bainitic microstructure, at least in part.

BACKGROUND

Flat steel products of the type in question here are typically rolled products such as steel strips or sheets, and blanks and plates produced therefrom.

High-strength flat steel products are growing in significance particularly in the field of motor vehicle construction, since they enable a reduction in the vehicle's intrinsic weight and an increase in the load capacity. A low weight not only contributes to optimal utilization of the technical performance capacity of the respective drive unit, but also promotes resource efficiency, optimization of costs and climate protection.

A crucial reduction in the intrinsic weight of steel sheet constructions can be achieved by an enhancement of the mechanical properties, especially of the strength of the flat steel product being processed in each case. As well as a high strength, modern flat steel products intended for motor vehicle construction are also expected to have good toughness properties, good brittleness resistance characteristics and optimal suitability for cold forming and welding.

It is known that this combination of properties can be achieved by choice of a suitable alloy concept and a specific production method. In the case of conventional methods of producing high-strength heavy plate having a minimum yield strength of 700 MPa, the procedure is as follows. First of all, the slabs are hot-rolled and, after rolling, cooled down under air. Thereafter, the sheets are reheated, hardened and subjected to a tempering treatment. The process thus contains several stages in order to attain the mechanical properties. The multitude of associated production steps leads to comparably high production costs. Exact process control is also required in order to attain the desired toughness properties and surface qualities.

EP 2 130 938 A1 discloses a method of producing a hot-rolled flat steel product, in which a melt is cast to slabs containing, as well as iron and unavoidable impurities (in % by weight) 0.01%-0.1% by weight of C, 0.01%-0.1% by weight of Si, 0.1%-3% by weight of Mn, not more than 0.1% by weight of P, not more than 0.03% by weight of S, 0.001%-1% by weight of Al, not more than 0.01% by weight of N, 0.005%-0.08% by weight of Nb and 0.001% to 0.2% by weight of Ti, where the following condition applies to the respective Nb content % Nb and the respective C content % C: $\% Nb \times \% C \cong 4.34 \times 10^{-3}$.

After the casting and solidification of the melt, in the known method, the steel slab is reheated up to a temperature range having a lower limit which is determined as a function of the C and Nb contents of the steel being cast in each case and an upper limit of 1170° C. Subsequently, the reheated slab is rough-rolled at an end temperature of 1080-1150° C. After waiting for 30-150 seconds, in the course of which the reheated slab is kept at 1000-1080° C., the preheated slab is then hot finish-rolled to give a hot strip. The forming level in the last draft of the hot rolling should be 3%-15%.

In the known process, the hot rolling is ended at a hot rolling end temperature corresponding at least to the Ar3 temperature of the steel being processed and of not more than 950° C. After the end of the hot rolling, the hot strip obtained is cooled down at a cooling rate of more than 15° C./s to a coiling temperature of 450-550° C., at which it is coiled to a coil.

In the hot strip thus produced, the grain boundary density of the carbon present in solid solution is to be 1-4.5 atoms/nm$^2$ and the size of the cementite grains separated out at the particle boundaries not more than 1 μm. The flat steel products having these properties and having been produced by the known method, given sufficiently high-dose alloy contents, are to have tensile strengths of more than 780 MPa and yield strengths of up to 726 MPa. In this way, the hot strip produced in the known manner is to have a combination of properties of particular suitability for use in automobile construction. Optimal surface characteristics are to be attained by restricting the reheating temperature to which the slab is heated prior to hot rolling to the abovementioned temperature range and hence avoiding excessive formation of scale which would be incorporated into the hot strip surface in the course of hot rolling.

BRIEF DESCRIPTION OF THE TABLES

Table 1 identifies compositions that have been smelted and cast to give slabs 1-26.

Table 2a identifies process parameters established in the processing of each of slabs 1-16.

Table 2b identifies process parameters established in the processing of each of slabs 17-26.

Table 3 identifies mechanical properties and microstructure constituents of hot strips.

DETAILED DESCRIPTION

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element.

The present disclosure relates to a method of producing a flat steel product having a yield strength of at least 700 MPa and having a bainitic microstructure to an extent of at least 70% by volume. Further, the present disclosure relates to a method of producing high-strength 'heavy plate' having a thickness of at least 3 mm. One example object of the present disclosure is to specify methods for producing high-strength steel sheets having mechanical properties optimized for use in automobile construction as well as having optimized surface characteristics. That said, it should be understood that all figures relating to contents of the steel compositions specified in the present disclosure are based on weight, unless explicitly mentioned otherwise. All indeterminate '% figures' connected to a steel alloy should therefore be regarded as figures in '% by weight.'

Accordingly, a method of the invention for producing a flat steel product having a yield strength of at least 700 MPa and having a bainitic microstructure to an extent of at least 70% by volume has the following steps:

a) smelting a steel melt consisting (in % by weight) of

| | |
|---|---|
| C: | 0.05%-0.08%, |
| Si: | 0.015%-0.500%, |
| Mn: | 1.60%-2.00%, |
| P: | up to 0.025%, |
| S: | up to 0.010%, |
| Al: | 0.020%-0.050%, |
| N: | up to 0.006%, |
| Cr: | up to 0.40%, |
| Nb: | 0.060%-0.070%, |
| B: | 0.0005%-0.0025%, |
| Ti: | 0.090%-0.130%, |

and of technically unavoidable impurities including up to 0.12% Cu, up to 0.100% Ni, up to 0.010% V, up to 0.004% Mo and up to 0.004% Sb, and of iron as the remainder;

b) casting the melt to give a slab;

c) reheating the slab to a reheating temperature of 1200-1300° C.;

d) rough-rolling the slab at a rough rolling temperature of 950-1250° C. and a total draft of at least 50% achieved by means of the rough rolling;

e) hot finish-rolling the rough-rolled slab, the hot finish rolling being ended at a hot rolling end temperature of 800-880° C.;

f) intensively cooling, starting from not more than 10 s after the hot finish rolling, the hot-finish-rolled flat steel product at a cooling rate of at least 40 K/s to a coiling temperature of 550-620° C.;

g) coiling the hot-finished-rolled flat steel product.

The method of the invention is based on a steel alloy having alloy constituents and alloy contents matched to one another within tight limits, such that maximized mechanical properties and optimized surface characteristics are attained in each case in a procedure that can be conducted in an operationally reliable manner.

As elucidated hereinafter, alloy constituents and alloy contents of the steel alloy smelted in accordance with the invention in step a) are selected such that, in the case of compliance with the steps specified in accordance with the invention, it is reliably possible to produce a hot-rolled flat steel product having a combination of properties that makes it particularly suitable for use in lightweight steel construction, especially in the field of utility vehicle construction:

C: The carbon content of the steel processed in accordance with the invention is 0.05%-0.08% by weight. In order to achieve the desired strength properties, a C content of at least 0.05% by weight is required. If, however, the carbon content is too high, the toughness properties or weldability and formability of the steel processed in accordance with the invention are impaired. For this reason, the carbon content is limited to not more than 0.08% by weight.

Si: Silicon is used as deoxidant in the steel being processed in accordance with the invention, and for improvement of the toughness properties. If, however, the silicon content is too high, the toughness properties, especially the toughness in the heat-affected zone of weld bonds, are greatly impaired. For this reason, the silicon content of the steel being processed in accordance with the invention is not to exceed 0.50% by weight. For reliable avoidance of defects in the surface quality, the silicon content can be limited to max. 0.25% by weight.

Mn: Manganese is added to the steel used in accordance with the invention in contents of 1.6%-2.0% by weight in order to establish the desired strength properties combined with good toughness properties. If the manganese content is less than 1.60% by weight, the required strength properties are not attained with the desired certainty. The restriction in the Mn content to max. 2.00% by weight avoids any deterioration in weldability, toughness properties, formability and segregation characteristics.

P: Phosphorus is an accompanying element which worsens notch impact energy and formability. The phosphorus content should therefore not exceed the upper limit of 0.025% by weight. In an optimal manner, the P content is limited to less than 0.015% by weight.

S: Sulfur worsens the notch impact energy and formability of a steel being processed in accordance with the invention as a result of MnS formation. For this reason, the S content of a steel being processed in accordance with the invention is to be not more than 0.010% by weight. Such a low sulfur content can be achieved in a manner known per se, for example by a CaSi treatment. In order to reliably rule out the adverse effect of sulfur on the properties of the steel being processed in accordance with the invention, the S content can be limited to max. 0.003% by weight.

Al: Aluminum is likewise used as a deoxidant and, as a result of AlN formation, hinders the coarsening of the austenite grain in the course of austenitization. If the aluminum content is below 0.020% by weight, the deoxidation processes do not run to completion. However, if the aluminum content exceeds the upper limit of 0.050% by weight, $Al_2O_3$ inclusions can form. These have an adverse effect on the purity level and toughness properties.

N: Nitrogen is an accompanying element which forms AlN with aluminum or TiN with titanium. If, however, the nitrogen content is too high, the toughness properties are worsened. In order to prevent this, in the case of a steel being processed in accordance with the invention, the upper limit for the nitrogen content is fixed at 0.006% by weight.

Cr: Chromium can optionally be added to a steel being processed in accordance with the invention, in order to improve its strength properties. If the chromium content is too high, however, weldability and toughness in the heat-affected zone are adversely affected. Therefore, in the case of a steel being processed in accordance with the invention, the upper limit for the chromium content is fixed at 0.40% by weight.

Nb: Niobium is present in a steel being processed in accordance with the invention in order to promote strength properties by grain refining of the austenite structure in the course of temperature-controlled rolling or by precipitation hardening in the course of coiling. For this purpose, the steel being processed in accordance with the invention includes 0.060%-0.070% by weight of Nb. If the niobium content is below this range, the strength properties are not attained. If the Nb content is above the upper limit of this range, there is a deterioration in weldability and toughness in the heat-affected zone of a welding operation.

B: The boron content of a steel being processed in accordance with the invention is 0.0005%-0.0025% by weight. B is used to promote strength properties and to improve hardenability. However, excessive boron contents worsen the toughness properties.

Ti: Titanium likewise contributes to improving the toughness properties by preventing grain growth in the course of austenitization or by precipitation hardening in the course of coiling. In order to assure this, the Ti contents of a steel being processed in accordance with the invention are 0.09%-0.13% by weight. If the titanium content is below 0.09% by weight, the strength values that are the aim of the invention are not attained. If the upper limit in the specified Ti content range is exceeded, there is a deterioration in weldability and toughness in the heat-affected zone of a welding operation.

Cu, Ni, V, Mo and Sb occur as accompanying elements which get into the steel being processed in accordance with the invention as technically unavoidable contamination in the process of steel production. The contents thereof are restricted to amounts that are inactive in relation to the properties of the steel being processed in accordance with the invention that are the aim of the invention. For this purpose, Cu content is restricted to max. 0.12% by weight, the Ni content to less than 0.1% by weight, the V content to not more than 0.01% by weight, the Mo content to less than 0.004% by weight and the Sb content likewise to less than 0.004% by weight.

In order to achieve good weldability, it is possible to adjust the contents of C, Mn, Cr, Mo, V, Cu and Ni of the steel of the invention within the limits specified in accordance with the invention such that the following condition applies to the carbon equivalent CE, calculated by the formula $$CE=\%\ C+\%\ Mn/6+(\%\ Cr+\%\ Mo+\%\ V)/5+(\%\ Cu+\%\ Ni)/15$$

with % C=respective C content in % by weight,
% Mn=respective Mn content in % by weight,
% Cr=respective Cr content in % by weight,
% Mo=respective Mo content in % by weight,
% V=respective V content in % by weight,
% Cu=respective Cu content in % by weight,
% Ni=respective Ni content in % by weight:
$CE \leq 0.5\%$ by weight.

After the slab has been cast, it is reheated to the austenitization temperature of 1200-1300° C. The upper limit in the temperature range to which the slab is heated for austenitization should not be exceeded in order to avoid coarsening of the austenite grain and increased scale formation. Within the reheating temperature range, specified in accordance with the invention, of 1200-1300° C., there is not yet increased formation of red scale that would lower the surface quality of the flat steel product being produced in accordance with the invention. Red scale forms in the course of processing of slabs of the composition of the invention exclusively in the hot rolling operation (steps d), e) of the process of the invention), when too much primary scale is present on the slab surface after reheating.

The lower limit for the reheating temperature, by contrast, is fixed such that the desired homogenization of the microstructure is assured with a homogeneous temperature distribution. Over and above this temperature, there is very substantially complete dissolution of the coarse Ti carbonitride and Nb carbonitride precipitates present in the respective slab in the austenite. In the subsequent coiling of the hot-finish-rolled flat steel product (step g) of the method of the invention), it is then possible for fine Ti carbonitride or Nb carbonitride precipitates to reform, and these, as elucidated, make an essential contribution to increasing the strength properties. In this way, it is assured that the flat steel products which have been produced and have the composition of the invention regularly have a minimum yield strength of 700 MPa.

According to the invention, the reheating temperature in the austenitization of the respective slab is at least 1200° C., in order to achieve the desired effect of maximum dissolution of the TiC and NbC precipitates. In the case of an austenitization temperature below 1200° C., the amount of carbide precipitates of Ti and Nb dissolved in the austenite, by contrast, is sufficiently low that the effects utilized in accordance with the invention do not occur. The result of a reheating temperature below 1200° C. in the case of processing of flat steel products of a composition corresponding to the alloy selection optimized in accordance with the invention would therefore be that the required strength properties are not attained. The very substantial dissolution of the TiC and NbC precipitates can be assured in a particularly reliable manner when the reheating temperature is at least 1250° C.

A flat steel product that meets the highest quality demands on its surface characteristics can be produced by completely removing scale present on the slab prior to the rough rolling. This can be accomplished by completely descaling the slab surface after discharge from the oven and as immediately as possible prior to the rough rolling. For this purpose, the slab can pass through a conventional scale washer.

To produce a flat steel product having optimized surface characteristics, the time t_1 required for the transfer of the slab from the station ("reheating (step c)") or the "removal of the primary scale (step c')") which optionally follows the reheating up to the start of the hot finish rolling (step e)) can be restricted to a maximum of 300 s. In an optimal manner, this includes the rough rolling. Within such a short transfer time, only such a small amount of primary scale is reformed that the red scale that forms therefrom in the course of hot rolling is not detrimental to the quality of the surface of the flat steel product obtained after the hot rolling. In the case that descaling is conducted prior to the rough rolling, the transport time between the descaling aggregate and up to the rough rolling structure should be not more than 30 s. In the case of such a short transport time, only a harmless thin oxide layer, if any, can form on the previously descaled slab.

In step d), the slab processed in each case is rough-rolled at a rough rolling temperature of 950-1250° C. The draft achieved in the rough rolling is at least 50% in total. The total draft $\Delta hv$ refers to the ratio formed from the difference of the thicknesses of the slab before (thickness dVv) and after (thickness dNv) the rough rolling and the thickness dVv of the slab prior to the rough rolling ($\Delta hv\ [\%]=(dVv-dNv)/dVv\times 100\%$).

The lower limit for the range specified for the rough rolling temperature and the minimum value of the total draft $\Delta hv$ are fixed such that the recrystallization processes can proceed to completion in each rough-rolled slab. In this way, the formation of a fine-grain austenitic microstructure is assured prior to the finish rolling, which achieves optimized toughness and fracture elongation properties of the flat steel product produced in accordance with the invention.

The residence time and delay time t_2 between the rough rolling and the finish rolling is limited to 50 s, in order to avoid unwanted austenite grain growth.

The rough rolling is followed, in step e), by the hot rolling of the rough-rolled slab to give a hot-rolled flat steel product having a hot strip thickness of typically 3-15 mm. Flat steel products having such thicknesses are also referred to in the art as "heavy plate".

The end temperature of this hot rolling is 800-880° C. By observing this hot rolling end temperature range, a highly stretched austenite grain is achieved in the microstructure of the hot strip obtained. The comparably low hot rolling end temperature enhances the effect of the hot rolling. Dislocation-rich austenite is present in the microstructure of the hot strip obtained. After intensive cooling (step f)), this is transformed to a dislocation-rich, finely structured bainite, such that the yield strength is raised. The upper limit in the range of the hot rolling end temperature is fixed such that no recrystallization of the austenite takes place in the course of rolling in the hot rolling finishing train. This too contributes to the development of a fine-grain microstructure. The lower limit temperature is at least 800° C. in order that no ferrite forms in the course of rolling.

The draft Δhf achieved in the finish rolling is at least 70% in total, the draft Δhf being calculated here by the formula $\Delta hf=(dVf-dNf)/dVf\times 100\%$ (with dVf=thickness of the rolling material on entry into the hot finish rolling relay and dNf=thickness of the rolling material on exit from the hot finish rolling relay). As a result of the high draft Δhf, the phase transformation from highly formed austenite takes place. This has a positive effect on the fine granularity, such that small grain sizes are present in the microstructure of the flat steel product produced in accordance with the invention.

Once the hot-finish-rolled flat steel product has emerged from the last stand of the hot rolling finishing train, intensive cooling sets in within not more than 10 s, in the course of which the hot-rolled flat steel product is cooled down at a cooling rate dT of at least 40 K/s to a coiling temperature of 550-620° C.

The cooling delay after the hot rolling is not more than 10 s, in order to prevent unwanted changes in microstructure between the hot rolling and controlled accelerated cooling.

By observing the range specified in accordance with the invention for the coiling temperature, the prerequisites for the formation of a bainitic microstructure of the flat steel product produced in accordance with the invention are established.

At the same time, the choice of coiling temperature has a crucial influence on precipitation hardening. For this purpose, the coiling temperature range is chosen in accordance with the invention such that it is firstly below the bainite starting temperature, and secondly at the precipitation maximum for the formation of carbonitride deposits. However, the effect of too low a coiling temperature would be that the precipitation potential would no longer be utilizable and hence the required minimum yield strength would no longer be achieved. The cooling conditions are chosen in accordance with the invention such that the hot-rolled flat steel product, immediately prior to the coiling, has a bainitic microstructure having a phase content of at least 70% by volume. Further bainite formation then proceeds in the coil. With regard to the required combination of properties, it is found to be optimal when the microstructure of the hot-rolled flat steel product produced in accordance with the invention, after the coiling, consists entirely of bainite for technical purposes. This is achieved by observing the coiling temperature range specified in accordance with the invention.

The high cooling rate prevents the formation of unwanted phase constituents. In order to obtain a flat steel product of optimal planarity, the cooling rate of the cooling after the hot rolling can be restricted to 150 K/s.

The yield strength of the hot-rolled flat steel products produced in accordance with the invention in the manner elucidated above is reliably 700-850 MPa. The fracture elongation is at the same time at least 12%. With equal regularity, flat steel products of the invention attain tensile strengths of 750-950 MPa. The notch impact energy determined for products of the invention is in the range of 50-110 J at −20° C. and in the range of 30-110 J at −40° C.

Flat steel products produced in accordance with the invention have a fine-grain microstructure with a mean grain size of not more than 20 μm, in order to achieve good fracture elongation and toughness.

At the same time, in the procedure of the invention, the aforementioned properties are present in a hot-rolled flat steel product in the rolled state after coiling. There is no need for any further heat treatment to establish or develop particular properties that are important for the intended use as high-strength sheet metal in utility vehicle construction.

The invention is elucidated in detail hereinafter by working examples.

Steel melts A-E having the compositions specified in table 1 have been smelted and cast in a known manner to give slabs 1-26.

Subsequently, the slabs consisting of steels A-E have been heated through to a reheating temperature TW.

From the reheating furnace, the reheated slabs have been transported within less than 30 s to a scale washer in which primary scale adhering thereon has been removed from the slabs.

The slabs that emerge from the scale washer have then been transported to a rough rolling stand, where they have been rough-rolled with a rough rolling temperature TVW and a total draft Δhv achieved by means of the rough rolling.

Subsequently, the rough-rolled slabs have been hot-finish-rolled in a hot finish rolling relay to give hot strips having a thickness BD and a width BB. The hot rolling operation has been ended in each case with a total draft in the hot finish rolling relay Δhf at a hot rolling end temperature TEW. The time that has passed between exit from the scale washer and the commencement of hot finish rolling was less than 300 s in each case.

The hot-finish-rolled flat steel product emerging from the last stand, after a delay t_p of 1-7 s, in which it is cooled down gradually under air, has been cooled down by means of intensive cooling with water at a cooling rate dT of 50-120 K/s to a coiling temperature HT. After the cooling, the flat steel products already have a bainitic microstructure to an extent of at least 70% by volume.

At this coiling temperature HT, the hot strips obtained have each been coiled to a coil. In the course of cooling of the flat steel products in the coil, there was complete transformation of the microstructure to bainite, such that the flat steel products obtained had an exclusively bainitic microstructure apart from other microstructure constituents that are unavoidable, i.e., the microstructure is 100% by volume bainite for technical purposes.

Tables 2a, 2b report the process parameters established in the processing of each of slabs 1-26 (reheating temperature TW, rough rolling temperature TVW, total draft Δhv achieved by means of the rough rolling, time t_1 between the descaling conducted after the preheating and prior to the rough rolling and commencement of the hot finish rolling, time t_2 between rough rolling and hot rolling, total draft Δhf achieved by means of the finish rolling, end rolling temperature TEW, cooling delay t_p between the end of the hot rolling and the commencement of forced cooling, cooling rate dT, coiling temperature HT, strip thickness BD and strip width BB).

The mechanical properties and the microstructure of the hot strips obtained have been examined.

The tensile tests for determining the yield strength ReH, tensile strength Rm and fracture elongation A have been conducted in accordance with DIN EN ISO 6892-1 on longitudinal samples of the hot strips.

The notched impact bending tests to determine the notch impact energy Av at −20° C. or −40° C. and −60° C. were conducted on longitudinal samples according to DIN EN ISO 148-1.

The microstructure studies were effected by means of a light microscope and scanning electron microscope. For this purpose, the samples were taken from a quarter of the width of the strip, prepared as a longitudinal section and etched with nital (i.e. alcoholic nitric acid containing a nitric acid content of 3% by volume) or sodium disulfite. The microstructure constituents were determined by means of a surface analysis at a sample location of ⅓ sheet thickness, as described in H. Schumann and H. Oettel "Metallografie" [Metallography] 14th edition, 2005 WILEY-VCH Verlag GmbH & Co. KGaA, Weinheim.

The mechanical properties and the microstructure constituents of the hot strips produced in accordance with the invention are reported in table 3. The sheet metal strips produced by the method of the present invention have high strength properties coupled with good toughness properties and good fracture elongation.

The yield strengths of the hot strips produced in the manner elucidated above are between 700 MPa and 790 MPa. Fracture elongation is at least 12%, and tensile strength 750-880 MPa. Notch impact energy at −20° C. is in the range of 60 to 100 J. At −40° C. the notch impact energy is 40 to 75 J and at −60° C. the notch impact energy is 30-70 J.

TABLE 1

| Steel | C | Si | Mn | P | S | Al | N | Cr | Nb | B | Ti | Cu | Ni | V | Mo | Sb |
|---|---|---|---|---|---|---|---|---|---|---|---|---|---|---|---|---|
| A | 0.060 | 0.42 | 1.77 | 0.012 | 0.0010 | 0.034 | 0.0046 | 0.04 | 0.062 | 0.0020 | 0.110 | 0.02 | 0.03 | 0.010 | 0.004 | 0.004 |
| B | 0.053 | 0.49 | 1.75 | 0.015 | 0.0014 | 0.034 | 0.0049 | 0.06 | 0.066 | 0.0020 | 0.091 | 0.02 | 0.03 | 0.005 | 0.004 | 0.004 |
| C | 0.061 | 0.22 | 1.79 | 0.014 | 0.0021 | 0.050 | 0.0047 | 0.04 | 0.063 | 0.0019 | 0.097 | 0.02 | 0.02 | 0.003 | 0.004 | 0.004 |
| D | 0.065 | 0.20 | 1.8 | 0.014 | 0.0021 | 0.040 | 0.0047 | 0.04 | 0.065 | 0.0005 | 0.110 | 0.02 | 0.02 | 0.003 | 0.004 | 0.004 |
| E | 0.070 | 0.03 | 1.89 | 0.011 | 0.0014 | 0.042 | 0.0051 | 0.04 | 0.060 | 0.0005 | 0.130 | 0.02 | 0.03 | 0.008 | 0.004 | 0.004 |

FIGS. in % by weight, remainder iron and unavoidable impurities

TABLE 2a

| No. | Steel | TW [° C.] | Δhv [%] | TVW [° C.] | t_1 [s] | t_2 [s] | Δhf [%] | TEW [° C.] | t_p [s] | dT [K/s] | HT [° C.] | BD [mm] | BB [mm] |
|---|---|---|---|---|---|---|---|---|---|---|---|---|---|
| 1 | A | 1293 | 85 | 1070 | 220 | 40 | 90 | 905 | 1 | 100 | 600 | 4 | 1525 |
| 2 | A | 1296 | 80 | 1065 | 220 | 40 | 92 | 915 | 1 | 100 | 600 | 4 | 1525 |
| 3 | A | 1288 | 80 | 1045 | 225 | 40 | 92 | 895 | 2 | 100 | 605 | 4 | 1525 |
| 4 | A | 1287 | 85 | 1045 | 230 | 42 | 90 | 880 | 2 | 100 | 605 | 4 | 1530 |
| 5 | A | 1269 | 82 | 1055 | 230 | 40 | 91 | 890 | 2 | 100 | 600 | 4 | 1525 |
| 6 | A | 1300 | 82 | 1050 | 240 | 45 | 82 | 835 | 3 | 70 | 600 | 8 | 1545 |
| 7 | A | 1296 | 82 | 1050 | 245 | 41 | 82 | 810 | 4 | 70 | 600 | 8 | 1545 |
| 8 | A | 1305 | 76 | 1060 | 240 | 42 | 86 | 825 | 4 | 70 | 600 | 8 | 1755 |
| 9 | A | 1247 | 76 | 1040 | 260 | 44 | 83 | 800 | 6 | 50 | 580 | 10 | 1530 |
| 10 | B | 1291 | 80 | 1060 | 230 | 40 | 90 | 910 | 2 | 100 | 600 | 5 | 1630 |
| 11 | B | 1309 | 80 | 1110 | 240 | 44 | 90 | 870 | 2 | 100 | 610 | 5 | 1630 |
| 12 | B | 1288 | 85 | 1070 | 230 | 40 | 88 | 890 | 2 | 100 | 600 | 5 | 1540 |
| 13 | B | 1304 | 76 | 1055 | 240 | 40 | 90 | 860 | 2 | 90 | 600 | 6 | 1540 |
| 14 | B | 1285 | 85 | 1030 | 255 | 42 | 75 | 800 | 5 | 50 | 590 | 10 | 1550 |
| 15 | B | 1296 | 85 | 1100 | 210 | 40 | 93 | 850 | 2 | 120 | 600 | 3 | 1280 |
| 16 | B | 1298 | 82 | 1090 | 200 | 40 | 93 | 900 | 1 | 120 | 580 | 3 | 1275 |

TABLE 2b

| No. | Steel | TW [° C.] | Δhv [%] | TVW [° C.] | t_1 [s] | t_2 [s] | Δhf [%] | TEW [° C.] | t_p [s] | dT [K/s] | HT [° C.] | BD [mm] | BB [mm] |
|---|---|---|---|---|---|---|---|---|---|---|---|---|---|
| 17 | B | 1206 | 82 | 1067 | 205 | 40 | 93 | 870 | 1 | 120 | 610 | 3 | 1275 |
| 18 | C | 1289 | 85 | 1040 | 260 | 45 | 75 | 800 | 6 | 50 | 550 | 10 | 1550 |
| 19 | C | 1291 | 85 | 1090 | 235 | 42 | 85 | 880 | 2 | 90 | 605 | 6 | 1535 |
| 20 | C | 1214 | 82 | 1070 | 230 | 40 | 91 | 865 | 2 | 100 | 600 | 4 | 925 |
| 21 | D | 1290 | 85 | 1090 | 205 | 40 | 93 | 890 | 1 | 120 | 620 | 3 | 1280 |
| 22 | D | 1285 | 82 | 1080 | 200 | 40 | 93 | 900 | 1 | 120 | 575 | 3 | 1275 |
| 23 | E | 1290 | 76 | 1060 | 260 | 43 | 83 | 800 | 6 | 50 | 598 | 10 | 1550 |

TABLE 2b-continued

| No. | Steel | TW [° C.] | Δhv [%] | TVW [° C.] | t_1 [s] | t_2 [s] | Δhf [%] | TEW [° C.] | t_p [s] | dT [K/s] | HT [° C.] | BD [mm] | BB [mm] |
|---|---|---|---|---|---|---|---|---|---|---|---|---|---|
| 24 | E | 1290 | 78 | 1090 | 235 | 40 | 89 | 860 | 3 | 90 | 615 | 6 | 1535 |
| 25 | E | 1290 | 80 | 1040 | 260 | 45 | 76 | 800 | 7 | 50 | 590 | 12 | 1530 |
| 26 | E | 1285 | 78 | 1045 | 260 | 45 | 73 | 822 | 7 | 50 | 570 | 15 | 1530 |

TABLE 3

| | | Position | Tensile test, longitudinal | | | Notched impact bending test, longitudinal | | | Micro-structure |
|---|---|---|---|---|---|---|---|---|---|
| No. | Steel | in coil | ReH [MPa] | Rm [MPa] | A [%] | Av-20° C. [J] | Av-40° C. [J] | Av-60° C. [J] | constituents % by vol. |
| 1 | A | start | 770 | 852 | 19.0 | n.d. | n.d. | n.d. | 100 bainite |
| 2 | A | start | 762 | 837 | 17.0 | n.d. | n.d. | n.d. | 100 bainite |
| 3 | A | start | 749 | 819 | 18.0 | n.d. | n.d. | n.d. | 100 bainite |
| 4 | A | start | 754 | 818 | 21.0 | n.d. | n.d. | n.d. | 100 bainite |
| 5 | A | start | 737 | 809 | 24.0 | n.d. | n.d. | n.d. | 100 bainite |
| 6 | A | start | 736 | 834 | 20.3 | 70 | 44 | 31 | 100 bainite |
| 7 | A | start | 739 | 842 | 15.7 | 81 | 62 | 31 | 100 bainite |
| 8 | A | start | 716 | 817 | 17.2 | 62 | 40 | 31 | 100 bainite |
| 9 | A | start | 733 | 832 | 23.5 | 79 | 68 | 65 | 100 bainite |
| 10 | B | start | 750 | 852 | 16.0 | n.d. | n.d. | n.d. | 100 bainite |
| 11 | B | start | 752 | 841 | 22.0 | n.d. | n.d. | n.d. | 100 bainite |
| 12 | B | start | 736 | 829 | 20.0 | n.d. | n.d. | n.d. | 100 bainite |
| 13 | B | start | 734 | 860 | 17.0 | 99 | 48 | 33 | 100 bainite |
| 14 | B | start | 717 | 846 | 18.0 | 84 | 58 | 30 | 100 bainite |
| 15 | B | start | 782 | 864 | 23.0 | n.d. | n.d. | n.d. | 100 bainite |
| 16 | B | start | 779 | 857 | 24.0 | n.d. | n.d. | n.d. | 100 bainite |
| 17 | B | start | 720 | 819 | 23.0 | n.d. | n.d. | n.d. | 100 bainite |
| 18 | C | start | 705 | 813 | 19.1 | 97 | 73 | 30 | 100 bainite |
| 19 | C | start | 718 | 783 | 24.0 | 80 | 60 | 31 | 100 bainite |
| 20 | C | start | 710 | 790 | 24.0 | n.d. | n.d. | n.d. | 100 bainite |
| 21 | D | start | 720 | 850 | 22.0 | n.d. | n.d. | n.d. | 100 bainite |
| 22 | D | start | 760 | 823 | 22.0 | n.d. | n.d. | n.d. | 100 bainite |
| 23 | E | start | 712 | 820 | 20.0 | 97 | 73 | 30 | 100 bainite |
| 24 | E | start | 713 | 825 | 23.0 | 80 | 60 | 31 | 100 bainite |
| 25 | E | start | 733 | 809 | 21.0 | 72 | 53 | 42 | 100 bainite |
| 26 | E | start | 727 | 821 | 19.2 | 83 | 76 | 67 | 100 bainite |

"n.d." = "not determined"

The invention claimed is:

1. A hot rolled flat steel product comprising (in % by weight):

C: 0.05-0.08%,
Si: 0.015%-0.500%,
Mn: 1.60%-2.00%,
P: up to 0.025%,
S: up to 0.010%,
Al: 0.020%-0.050%,
N: up to 0.006%,
Cr: up to 0.40%,
Nb: 0.060%-0.070%,
B: 0.0005%-0.0025%,
Ti: 0.090-0.130%
technically unavoidable impurities including up to 0.12% Cu, up to 0.100% Ni, up to 0.010% V, up to 0.004% Mo and up to 0.004% Sb, and
the remainder being iron,
wherein the hot rolled flat steel product has a yield strength of 700-850 MPa, a fracture elongation of at least 12%, a microstructure comprising at least 70 vol. % bainitic microstructure, and a mean grain diameter of a microstructure of the hot rolled flat steel product is 20 μm or less.

2. The hot rolled flat steel product of claim 1, wherein the hot rolled flat steel product comprises less than or equal to 0.5% by weight of a carbon equivalent (CE), wherein CE=% C+% Mn/6+(% Cr+% Mo+% V)/5+(% Cu+% Ni)/15,
wherein % C is a respective C content in % by weight,
wherein % Mn is a respective Mn content in % by weight,
wherein % Cr is a respective Cr content in % by weight,
wherein % Mo is a respective Mo content in % by weight,
wherein % V is a respective V content in % by weight,
wherein % Cu is a respective Cu content in % by weight, and
wherein % Ni is a respective Ni content in % by weight.

3. The hot rolled flat steel product of claim 1, wherein the thickness of the hot rolled flat steel product is 3-15 mm.

4. The hot rolled flat steel product of claim 1, wherein the tensile strength of the hot rolled flat steel product is 750-950 MPa.

5. The hot rolled flat steel product of claim 1, wherein the notch impact energy of the hot rolled flat steel product at −20° C. is 50-110 J.

6. The hot rolled flat steel product of claim 1, wherein the hot rolled flat steel product has an exclusively bainitic structure apart from other microstructure constituents that are unavoidable.

7. The hot rolled flat steel product of claim 1, wherein the sulphur content is at most 0.003% by weight.

8. A component for a utility vehicle comprising the hot rolled flat steel product of claim 1.

9. The hot rolled flat steel product of claim 4, wherein the notch impact energy of the hot rolled flat steel product at −20° C. is 50-110 J.

10. The hot rolled flat steel product of claim 9, wherein a mean grain diameter of a microstructure of the hot rolled flat steel product is 20 μm or less.

11. The hot rolled flat steel product of claim 4, wherein a mean grain diameter of a microstructure of the hot rolled flat steel product is 20 μm or less.

12. The hot rolled flat steel product of claim 5, wherein a mean grain diameter of a microstructure of the hot rolled flat steel product is 20 μm or less.

* * * * *